United States Patent [19]

Richter et al.

[11] 4,194,686

[45] Mar. 25, 1980

[54] METHOD OF MONITORING AND CONTROLLING THE TRAVEL AND OPERATION OF THE TRAVELLING ACCESSORY MACHINES IN A COKING INSTALLATION

[75] Inventors: Jürgen Richter, Mülheim; Alois Purrer, Erlangen; Werner Eisenhut, Essen, all of Fed. Rep. of Germany

[73] Assignees: Krupp-Koppers GmbH; Bergwerksverband, both of Essen, Fed. Rep. of Germany

[21] Appl. No.: 843,794

[22] Filed: Oct. 20, 1977

[30] Foreign Application Priority Data

Oct. 23, 1976 [DE] Fed. Rep. of Germany ..... 2648049

[51] Int. Cl.[2] ..... G06F 15/46; G06K 7/08

[52] U.S. Cl. ..... 235/376; 235/449

[58] Field of Search ..... 235/375, 376, 487, 449; 340/146.3 K

[56] References Cited

U.S. PATENT DOCUMENTS

| | | | |
|---|---|---|---|
| 2,693,525 | 11/1954 | Kendall et al. | 340/146.3 K |
| 2,877,718 | 3/1959 | Mittag | 340/146.3 K |
| 3,034,590 | 5/1962 | Noble | 235/487 |
| 3,238,358 | 3/1966 | Read | 235/487 |
| 3,766,363 | 10/1973 | Dhooge | 235/375 |

*Primary Examiner*—Daryl W. Cook

*Attorney, Agent, or Firm*—Michael J. Striker

[57] ABSTRACT

A larry car, a quenching car, a pusher and other such accessory machines travel along the length of a coke-oven battery. Each coke oven is provided with coded structure absolutely indicative of the oven-number of the oven within the battery. The travelling accessory machines are provided with code readers which sense the coded structures and transmit oven-number feedback signals to a central control station. The travelling machines also transmit operation-completed signals upon completion of the individual operations of charging, pushing and the like. A programmed control system at the control station transmits travel-command and operation-command signals in preprogrammed sequences, but the transmission of these command signals is dependent upon the reception of predetermined feedback signals, which establish interlocks serving as conditions precedent to the travel of accessory machines and to their performance of individual operations.

9 Claims, 1 Drawing Figure

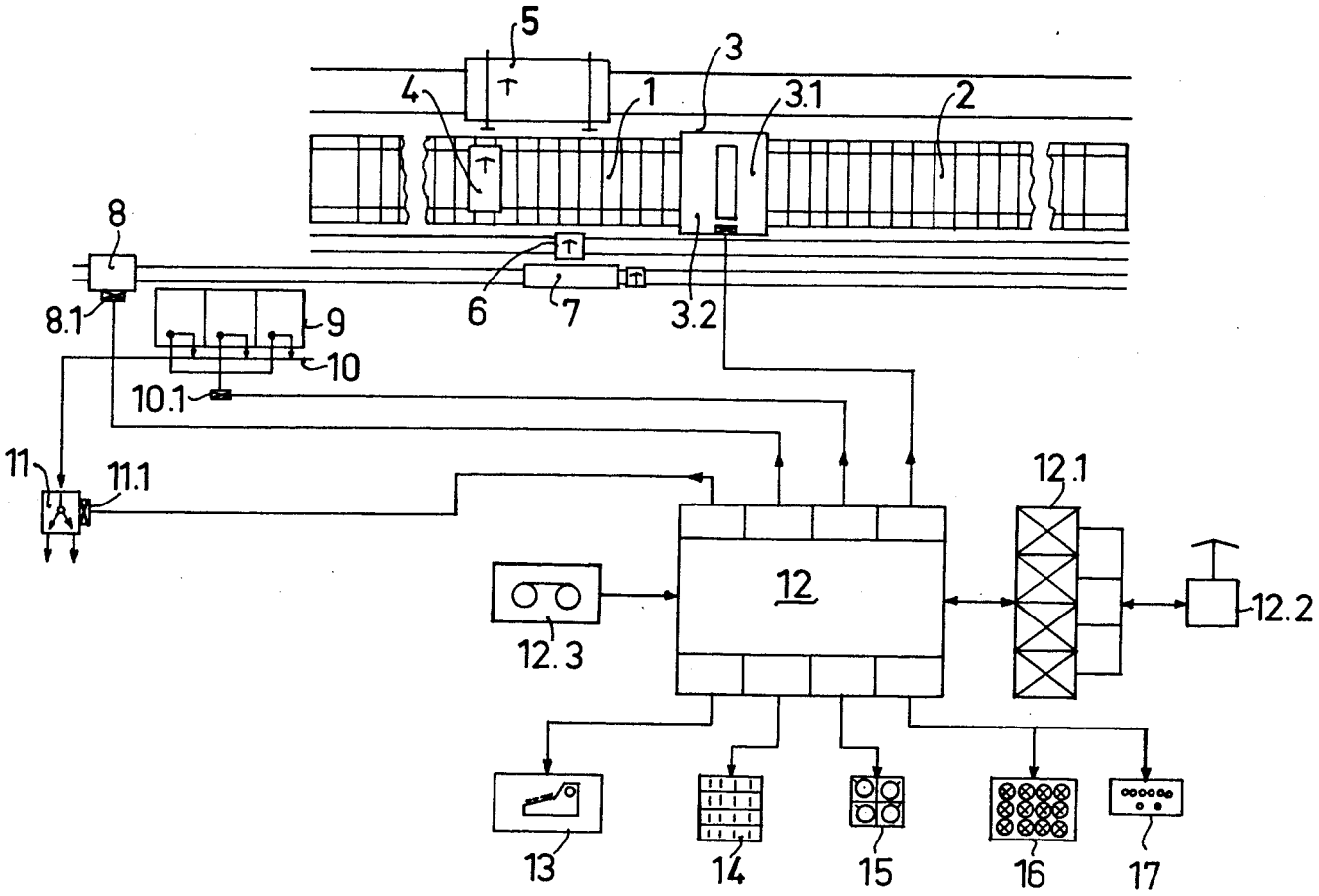
1
2
3
3.1
3.2
4
5
6
7
8
8.1
9
10
10.1
11
11.1
12
12.1
12.2
12.3
13
14
15
16
17

METHOD OF MONITORING AND CONTROLLING THE TRAVEL AND OPERATION OF THE TRAVELLING ACCESSORY MACHINES IN A COKING INSTALLATION

BACKGROUND OF THE INVENTION

The invention concerns methods of controlling and monitoring the operation of coke-oven accessory machines, such as larry cars, guide cars, pushers, quenching cars, and the like, and auxiliary stations such as overhead coal bins, quenching towers and coke wharves.

Controlling and monitoring the operation of coking installations, including the accessory machines and auxiliary stations mentioned above, places great demands upon the alertness and concentration of the operating personnel. The various accessory machines, such as the charging larries, the pushers, and so forth, must be brought into exactly correct positions relative to the middle of each oven in a battery of coke ovens and, furthermore, into predetermined positions relative to one another. This is particularly the case when charging the coke ovens by means of the charging larry and, also, during performance of the pushing operation, in which the pusher, the guide car at the coke side of the oven, and the quenching car at the coke side of the oven, must all be brought into exact register with the oven to be pushed.

Attempts have been made in the art to establish interlocks dependent upon proper positioning of pushers, guide cars and quenching cars relative to the oven to be pushed and relative to one another. In German allowed patent application DT-AS 24 21 631, a system is disclosed for doing this, utilizing contactless pulse generators and receivers. Another possibility which has been considered makes use of beamed radiation transmitted by a transmitter through the two open sides of an individual oven and detected by receivers; the radiation could be gamma radiation, high-frequency electromagnetic radiation, or light.

It has also been proposed to make use of electromagnetic contactors. Most interestingly, German published patent application DT-OS 1,571,640 discloses the establishment of an interlock dependent upon the ascertainment of certain positions; however, the information concerning the reaching of certain positions is derived by counting increments of the distance travelled by the accessory machines in question.

These known arrangements have the disadvantage that they require the provision of sensitive electrical and/or electronic devices in the immediate vicinity of the hot coking ovens, and must therefore be installed, operated and connected to cables extending through this physically severe environment. For this reason, and also for reasons relating to the monitoring concepts basic to prior-art monitoring and control proposals, such systems are more than acceptably susceptible to malfunction.

Additionally, the individual operations involved in the operation of a coking installation are numerous and must be performed in certain sequences which are dependent, inter alia, upon the coking times of the individual ovens. To the extent that the sequencing and timing of these operations must be controlled by operating personnel, great demands are placed upon the attention and concentration of the personnel.

SUMMARY OF THE INVENTION

It is a general object of the invention to provide a method of monitoring and controlling the operations involved in the operation of a coking installation, such that the monitoring functions which must be performed by operating personnel are minimized and simplified, and such that the various interlocks to be established as prerequisites for the performance of various individual operations are established with an unprecedented degree of reliability and unequivocalness.

With the inventive method, the positions of the accessory machines (charging larries, quenching cars, etc.,) which travel along the coke-oven battery are ascertained in a particularly informative and unequivocal manner. Coded structure, such as coded plates, are arranged along the path of travel of the accessory machines, and the machines themselves are provided with code readers. Preferably, the coded information is directly indicative of the oven-number of each oven in the battery of coke ovens. When one of the travelling accessory machines reaches a particular one of the coke ovens, the code reader on the machine detects the coded information indicative of the oven-number in the battery, and generates a corresponding oven-number signal, uniquely and unequivocally identifying the coke oven reached. Reliance is not placed upon distance-travelled totalizers or other such means which calculate, indirectly, which oven has been reached by a particular accessory machine. Instead, the coded information at each oven in the battery is indicative of the respective oven-number, absolutely.

Additionally, the machines are provided with means for generating operation-completed signals. For example, after a coke oven has been charged, a charging-completed signal is generated, and establishes an interlock constituting a prerequisite for the performance of the coke-levelling operations (opening of the leveling door, operation of the levelling bar, closing of the leveling door, and the like). These various operation-completed signals are generated by means of trips, sensors or other such transducers provided on the accessory machines.

The machine-position (e.g., oven-number) signals, and the operation-completed signals are telemetrically transmitted from the accessory machines to a central station or control tower, where they are received, decoded and fed into a programmed control system.

The control system is programmed for the performance of the individual operations involved in the operation of the coking installation, in the proper sequences and with proper timing. The control system establishes interlocks prerequisite to the initiation of the various operations to be performed. The interlocks are dependent upon the receipt of position signals (e.g., oven-number signals) corresponding to preprogrammed required-position information, and the interlocks are also dependent upon the receipt of signals indicating that the operation(s) precedent to the operation to be initiated have in fact been performed. In particular, the charging and pushing operations are interlocked with comparison between the transmitted and received actual-position (e.g., oven-number) signals and the preprogrammed required-position information.

The coded structures distributed along the travel paths of the accessory machines are preferably code plates made of metal and having embedded therein permanent magnets whose spatial organization, number and/or combination of north and south poles, or the like, is absolutely indicative, in coded form, of the respective location along the travel path of the associated accessory machine. For many purposes, the coded information will be absolutely indicative, in particular, of the oven-number of the individual oven within the battery of ovens. However, the code plates may also be arranged at positions not corresponding to individual ovens; for example, the quenching car is to be brought into a position for coke-spreading at the coke wharf of the installation, and the coke wharf will therefore be provided with coded structure absolutely indicative of the coke-wharf location to which the quenching car has been moved.

The coded structure could be comprised of code-structure elements (e.g., magnets) arranged in respective tracks which extend along the travel path of the associated accessory machine. Each code-structure element of each individual coded structure could, for example, correspond to one bit of a binary number encoded by such structure. In that event, it is preferred that the binary-coded position numbers of the successive coded structures differ, each from the preceding one, with respect to only one bit, e.g., in a simple ascending or descending numerical sequence. This makes for orderliness in the control and monitoring system and, additionally, makes it possible to double-check the operation of the position-detecting equipment, because of the one-bit-at-a-time progression which will be generated during accessory-machine travel when the position-detecting equipment is operating properly.

When binary digital coding is employed, it is preferred that the zeroes and ones of the coded position numbers be established by distinguishable polarity of the individual permanent magnets associated with the individual bits of the code numbers.

The code readers on the travelling accessory machines are peferably comprised of magnetic sensors, such as Hall generators. For example, each Hall generator in a Hall-generator row extending transverse to the travel direction may sense whether the one bit associated therewith is a zero or one. The combined output signals of the Hall-generator row then constitute the binary coded oven-number or other such position signal.

Each accessory machine is provided with one or more modulators and a transmitter. The coded position signal is modulated onto a distinguishable carrier associated with the respective accessory machine and transmitted to a central control station or control tower. The carriers associated with different ones of the accessory machines are advantageously of different frequency, so that the information received at the control station can always be correlated with the correct accessory machine. Additionally, the accessory machines are provided with further signal generators which generate operation-completed signals. For example, at the end of a levelling operation, when the door closer has closed the levelling door, a signal generator on the pushing machine generates a levelling-operation-completed signal, which is then modulated onto the respective carrier, and transmitted to the control station. Similar signals are generated for the other individual operations to be performed, such as opening and closing of the charging holes of the individual oven, opening and closing of the oven end doors for the performance of a pushing operation, opening of the discharge gates of the quenching car when the latter is properly positioned at the coke wharf, and so forth. These, likewise, are modulated onto their respective carriers and transmitted to the control station.

The transmission of the position and operation-completed signals from the accessory machines to the control station can be performed by a transmitting antenna inductively coupled to antenna loops extending along the travel paths of the accessory machines, or by means of wireless radio transmission to a receiving antenna located at the control station.

The signals received at the control station are demodulated and correlated with the respective accessory machines and, if not already in a form suitable for signal processing, decoded and then fed in, as feedback information, into the programmable and preprogrammed control system at the control station.

The preprogrammed control system, in dependence upon the feedback information, and in dependence upon elapsed-time information concerning the course of ongoing processes, such as the coking itself, generates command signals. The command signals indicate what coking ovens the accessory machines should move to next, and what operations are to be performed when the machines reach the oven in question. These command signals are preferably coded signals which are modulated onto different carrier frequencies, receivable by different ones of the accessory machines. The accessory machines are provided, for example, with receiving antennas, and the signals received at each accessory machine are demodulated and, if necessary, decoded, and initiate the next operation to be performed. When the next operation to be performed is travel of an accessory machine to a particular coke oven, for example, the command signal therefor is transmitted to the machine itself, if the machine is locomotive; if the prime mover of the machine is remotely located, for example at one end of the machine travel path, the command signal commanding machine travel would of course be transmitted to the remotely located prime mover.

It will be understood that a great variety of coding and modulation combinations could be used. For example, it is not absolutely necessary that a carrier of different respective frequency be associated with each machine to be monitored and controlled. The information modulated onto a carrier could itself include information correlating command signals with particular accessory machines.

It will be understood that certain essential equipment in a coking installation is not mobile in the sense of the accessory machines just referred to. Examples include the overhead coal bin for loading the charging larries, the quenching tower, the coal wharf, and so on. The control station likewise transmits command signals to this equipment, for example command signals commanding that the quenching tower start and terminate a quenching operation, that the wharf gates at the coal wharf open so that the spread and quenched coal can slide off the sloping surface of the wharf onto the conveyor belt which transports the quenched coal to the screening station, and so forth. Inasmuch as this equipment is not mobile, the transmission of command signals thereto from the control station can, if desired, be performed by cable. Likewise, inasmuch as this stationary equipment does not create the positioning problems associated with the mobile accessory machines, the transmission of information between stationary equipment and the control station can be one-way, i.e., from the latter to the former, although feedback information (e.g., a "wharf gates have just been opened" signal) could be fed back to the programmed control and monitoring system, to improve overall system reliability.

The aforedescribed system for moving travelling accessory machines from one coke oven to another in itself involves negative-feedback control, in a certain sense. If, for example, the pusher is presently located at a certain coking oven and is moved to another, the present oven-number transmitted back to the control system at the control station constitutes feedback information which may, for example, be used to generate a signal indicating the direction in which the pusher must travel to reach the oven to which it is to be moved.

In addition, however, it is contemplated to use negative-feedback position control for very exact positioning of travelling accessory machines relative to the exact middles of the coking ovens to which they are to be moved, or to other such reference points. In particular, it is contemplated that each coking oven be provided with coded structure readable by code readers on the travelling accessory machines, and utilized to generate fine-positioning negative-feedback information after the accessory machine has been brought to the oven of the correct oven-number, for the purpose of moving the machine into very exact register with the oven in question. In particular, when the accessory machine has been moved to a particular oven, the fine-positioning negative-feedback information should indicate the direction in which the machine must be further moved to bring it into exact register with the oven. For example, the fine-positioning negative-feedback information may be constituted by a negative signal indicating that the machine must be moved back somewhat, a positive signal indicating that the machine must be moved forward somewhat more, and a zero signal when the machine has been moved into exact register with the oven in question. Preferably, this negative-feedback fine-positioning of the accessory machines is implemented using additional coded structure, preferably magnetically coded plates, precisely located at each coking oven, and read by auxiliary code readers on the travelling accessory machines.

The fine-positioning negative-feedback positioning information could be in the form of a simple three-valued signal (positive, zero, negative) which indicates only whether a positioning error is still present and the sense of the error, or could have analog or pseudo-analog characteristics, i.e., additionally indicative of the amount of the positioning error. The coded structure used to implement the fine-positioning action could be comprised, for example, of two magnets located at the coking oven. When the code reader on the accessory machine is past the position of register with the oven in a first direction, it would generate a positive signal because it is sensing one magnet; when it is past the position of register in the opposite direction, it would generate a negative signal because it is sensing the other magnet; when it is at the position of register, it would generate a zero signal because it is sensing neither of the two magnets or, for example, both the magnets. Equivalent possibilities are within the scope of the concept in question; for example, the aforementioned two magnets might be relatively large, as measured in the machine travel direction, and a further magnet of short length, as measured in the travel direction, could be sensed by a separate sensor only when the accessory machine is in exactly the position of register with the oven.

The most essential aspect of the invention is the interlock of the operations performed by the travelling accessory machines and the reaching of positions of exact register with the ovens at which the operations are to be performed, because this constitutes the greatest control and monitoring problem for the system. However, the invention also contemplates control of any or all of the rest of the coking installation. To this end, the programmable control system can be programmed for control and monitoring of oven charging, loading of the charging larries, control of the duration of the coking per se, the sequences and times at which the individual ovens are to be pushed, the control of the discharge gates of the overhead coal bin, the quenching operations to be performed at the quenching tower, the spreading of the quenched coke at the coke wharf, the opening of the wharf gates leading into the conveyor for transporting the coke to the screening station, the operations performed at the screening station, and so forth.

For example, the program used to program the control system may include all information determinative of the operations to be performed and the sequences in which they are to be performed, but with the omission of certain information concerning, for example, the coking time for the individual ovens, the quenching time, the drying time for the quenched coke spread out at the coke wharf, and so on. The programming of the control system with respect to the durations of these operations is completed, for example, by manually setting time-duration selectors at the control station, e.g., in dependence upon the type of coal to be coked and/or the type of coke to be produced. When the operator sets these time-durations, this time-duration information is fed into the control system and completes the programming thereof. When the last operation preceding one of these variable-duration operations is completed, a timer is activated. For example, at the end of a charging operation, after the charging larry has replaced the covers for the charging holes and all steps in the levelling operation have been performed, the last step in this sequence initiates the operation of a timer which generates elapsed-time information. The elapsed-time information is continually compared against the desired-coking-duration information fed in by the operator using the time-duration selector. When the elasped-time information corresponds to the desired-coking-duration information, the next in the sequence of operations for the oven in question is performed; i.e., the pusher, the guide car and the quenching car are moved to the oven in question, the oven doors are extracted, the pushing operation is performed, and so on. Each of these individual operations, but especially the movement of these travelling accessory machines into register with the oven in question, result in the generation of feedback signals which are transmitted back to the control station, for interlock and also monitoring purposes.

Preferably, the control system is also provided with a protocol printer, which prints out information concerning the times at which the charging operations, the pushing operations, and the like, have been performed, the times at which the coking per se has been initiated and terminated, and so on, as a further aid to monitoring, but more importantly for subsequent review and analysis. Various features can be built into this protocol print-out; for example, if for one reason or another the time allotted to the coking per se in a particular oven deviates from the preselected time, the corresponding print-out information may be printed in red ink.

Finally, the invention also contemplates the concept of additionally programming the control system at the control station for the processing of more than one type of coal at a time. This would involve, for example, commanding that the charging larry receive coal of a particular type from one of a plurality of bunkers at the overhead coal bin, for delivery to a particular one of the coking ovens. Then, the coking duration per se would be correlated with the type of coal with which that oven had been charged; for example, different durations can be preselected for the different coal types, and the control system correlates the different coking durations with the different coal types it has commanded for the different ovens. Likewise, after the coal has been pushed from an oven, the duration of the quenching operation performed when the quenching car reaches the quenching station would similarly be performed in dependence upon the coal type. When the gates of the quenching car are to be opened, to spread the quenched coke onto the sloping surface of the coke wharf, the quenching car will first have been moved to the coke wharf. Then, the discharge gates of the coke wharf zone for the coal type involved are opened and, correlated therewith, the screening station is commanded to route the coke transferred thereto in one direction or another, so that the different types of coke produced will not become intermixed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic depiction of a coking installation and of the manner in which the operations performed within the coking installation are monitored and controlled in accordance with the invention.

DESCRIPTION OF THE PREFERRED EMBODIMENTS

The single FIGURE schematically depicts a coking installation and a monitoring and control system therefor, and is referred to for the purpose of explaining how the inventive method is performed.

The coking installation includes a coke-oven battery comprised of two sections 1 and 2, each comprised of a series of coke ovens. Located at the middle of the coke-oven battery is an overhead coal bin 3 comprised of bunkers containing coal to be coked and, as explained below including a plurality of bunkers containing coal of different respective types. The overhead coal bin is provided at its bottom with controllable loading gates, for loading coal into a larry car. The loading station is also provided with track scales 3.1 for weighing the amount of coal loaded into a larry car. The loading station is furthermore provided with control means 3.2 for opening and closing the loading gates of the overhead coal bin and, in accordance with another feature described below, for opening the gates from one or another bunker within the loading station in order to fill the larry car with coal of one or another type.

The larry car per se is denoted by numeral 4 and travels on rails along the tops of the ovens in the battery. The larry car 4 is shown provided with an antenna system, for the transmission of feedback information to the monitoring and control system, described below, and for the reception of command information therefrom. The larry car 4, in conventional manner, is provided with extractors for removing and replacing the covers of the charging holes of the coke ovens, and with gates for filling the coke ovens with coal.

The pusher is denoted by numeral 5. In conventional manner it is mounted on rails for travel along the pusher side of the coke-oven battery. Likewise in conventional manner, it includes extractors for opening and closing the levelling doors at the tops of the pusher sides of the individual ovens and for opening and closing the end doors at the pusher-sides of the ovens for pushing operation; it is provided with a levelling bar for performing the conventional levelling operation; and it is provided with a pushing ram for pushing coke out of the individual ovens. Like larry car 4, pusher 5 is provided with a transmitting and receiving antenna system, for transmitting to the control station information specifying the oven-number of the oven at which the pusher is located at any given time, fine-positioning feedback information concerning the exact position of the pusher relative to the position of register with the oven, and feedback information (operation-completed signals) indicating that various individual operations (opening of the levelling door, levelling, closing of the levelling door, opening of the pusher-side end door, pushing, closing of the end door) have been performed. This feedback information, transmitted to the control station, is utilized at the control station for establishing interlocks; e.g., the opening of the end door for a pushing operation is not performed until after the control station has received feedback information indicating that the pusher is exactly in the correct position of register relative to the middle of the oven to be pushed. Likewise, the antenna system of the pusher receives command signals, commanding that the pusher move to a certain oven, and commanding that the various individual operations mentioned above be performed.

Numeral 6 denotes the guide car of the battery, mounted on rails for travel along the coke-side of the battery. Numeral 7 denotes the quenching car of the battery, likewise mounted on rails for travel along the coke-side of the battery, and for carrying pushed coke to the quenching station 8. The guide car 6 may be provided with a door extractor for opening and closing the coke-side end doors of the individual ovens, or a separate travelling door-extractor machine could be provided. The guide car 6 and the quenching car 7, here again, are provided with transmitting and receiving antenna systems, for transmitting to the control station feedback information indicative of the oven-number at which these machines are currently located, of the exact position of these machines relative to the correct position of register with an individual oven, and feedback signals indicating what individual operations (e.g., door extraction) have been completed. Likewise, these machines receive from the control station command signals, commanding that these machines move to specified coke ovens, to specified stations (e.g., the quenching station in the case of the quenching car) and commanding that certain individual operations be performed (e.g., extraction of the coke-side end door of an oven).

Numberal 8 denotes the quenching tower of the coking installation. The quenching car 7, at the end of a pushing operation, conveys the incandescent coke to the quenching station 8, at which the incandescent coke is sprayed with water for quenching purposes. The quenching station 8 is stationary and is provided with control means 8.1 for controlling the quenching operation in dependence upon command signals received from the central control station. The control station furnishes signals commanding that quenching be initiated and terminated, and possibly control information concerning the establishment of one or another water-spraying mode, if the quenching station is set up for selectable control of water-spraying mode. Quenching is not initiated until the quenching car 7 actually reaches the quenching station 8 and transmits to the central control station information to that effect.

After the incandescent coke is quenched, the quenching car 8 is commanded to travel to the coke wharf 9, and when the quenching car 8 reaches the wharf 9, its discharge gates are opened, and the quenched coke is discharged and spread onto the sloping surface of the wharf 9.

After the quenched coke has dried at the coke wharf 9, the discharge gates of the wharf are opened, and the dried coke is transferred onto a conventional belt conveyor 10, for transparent to the screening station 11. The coke wharf 9 is provided with control means 10.1, for controlling the transfer of dried coke from the wharf 9 onto the conveyor 10, in response to command signals from the central control station.

The screening station 11 performs conventional screening and sorting operations. Additionally, because simultaneous coking of more than one type of coal is contemplated, the screening station 11 is provided with schematically indicated routing means, shown in the form of a routing baffle system for routing coked coal of different types in different directions, e.g., onto one or another loader for loading the coke onto one or another railroad car. The stationary screening station 11 is provided with control means 11.1, which controls the performance of the screening operation and the just mentioned routing function, in dependence upon command signals received from the central control station.

The central control station at the control tower includes a programmable control and monitoring system 12; a transmitter and receiver system 12.1 which encodes, modulates and transmits command information and which receives, demodulates and decodes received feedback information; an antenna system 12.2 for the transmission of command information and for the reception of feedback information; a perforated-tape programmer 12.3; a protocol printer 13; an oven-number display 14 for displaying the oven-number of the oven at which each one of the travelling accessory machines is located at any given time; a set of time-duration selectors for selecting the duration of incompletely preprogrammed operations; an illuminated display 16 for indicating what operations are being performed by which accessory machines (e.g., extraction of the covers of the charging holes of an oven by the larry car located thereabove, etc.); and a crossbar distribution panel 17 into which the control personnel can insert plugs to remove individual ovens from the coking program.

Inasmuch as the loading station 3, the quenching station 8, the coke wharf 9 and the screening station 11 are stationary, the command signals which the programmable control system 12 furnishes to the aforementioned control means 3.2, 8.1, 10.1, 11.1 thereat can be transmitted by means of cables.

The programmable control system 12 is programmed by a perforated-tape programmer 12.3. The program established within control system 12, at its simplest, can be essentially a simple step-by-step program, in which the individual operations to be performed are enumerated and commanded in consecutive order, but with feedback-information prerequisites which establish the necessary interlocks. For example, the first operation to be performed would be moving the charging larry 4 to the loading station 3. The second operation to be performed would be the opening of the loading gates at the bottom of the overhead coal bin at the loading station 3, to fill the charging larry 4. The condition precedent to the performance of the second operation, which establishes the interlock for the second operation, is the reception by the control system 12 of feedback information indicating that the charging larry 4 has, in fact, been moved to the loading station 3, and into exactly proper position at the loading station 3. Thus, in such a step-by-step program, the first step is to move the charging larry 4 to the loading station 3; the first interlock-condition is to wait with the second operation until feedback information is received indicating the arrival of the charging larry at the loading station; then, the second operation is the loading of the charging larry, and so forth.

After all the individual operations associated with the loading of the charging larry have been performed, the next main step would, for example, be to move the charging larry to oven #1. The next-following operation to be performed would be extraction of the covers of the oven charging holes, and the interlock condition prerequisite to this operation would be that the larry car in fact have reached oven #1, as indicated by the feedback of the oven-#1 information from the larry car to the control station.

The most important interlock conditions to be established all involve the arrival of one or more of the travelling accessory machines at the oven corresponding to the commanded oven-number, and the exact positioning of the accessory machine in proper register with the oven in question. Thus, the individual operations involved in the charging of one oven are not to be performed until the interlock condition (that the larry car has reached the correct oven and moved into exact register therewith) has been met. The interlock condition for the individual operations involved in pushing is constituted by a combination of interlock conditions, namely that each one of the pusher, the guide car and the quenching car have arrived at the correct oven and moved into the exactly correct position of register therewith.

These are the most important interlocks, i.e., the interlocks constituted by the feedback of information indicating that one or more accessory machines have moved into exact register with the oven of the oven-number specified by the command signal transmitted from the control station. Additional interlocks can be provided, to the extent desired, for example, as between a series of individual operations all performed while an accessory machine is in register with a particular oven. For example, in the case of charging, the series of individual operations involved in the charging of an oven might have as their interlock condition that both the charging larry and the pusher (provided with the leveller) be in exact register with the oven to be charged. Thereafter, the individual operations (such as opening of the levelling door, levelling by means of the levelling bar, and closing of the levelling door) could be performed at preprogrammed time intervals without interlocks; or alternatively, an interlock condition (opening of the levelling door, signalled by the feedback information transmitted back to the control station) could be established as a condition precedent for the levelling operation per se, and so on.

The program established by the perforated-tape programmer 12.3 can be complete or incomplete. For example, an important variable in the operation of a coking installation is the coking duration itself, which is dependent upon the type of starting material and the type of coke desired. The information indicating how much time (i.e., the coking duration per se) is to elapse between the charging and levelling of an oven, on the one hand, and the pushing of the oven, on the other hand, could be included in the perforation-coded information of the programming tape itself. However, inasmuch as coking time is variable, it is preferred that the durations of variable time intervals (coking duration, quenching duration, drying duration) be left open in the preestablished program; instead, the durations of these time intervals can be manually set by the operating personnel, using the time-interval selectors 15. Thus, depending upon the type of starting material and finished material involved, the operating personnel would select different values for the coking duration, quenching duration and drying duration. The program instructions would include commands that the pushing of a particular oven be made to occur following the charging of the oven, after the elapse of the time interval set on the coking-time time-interval selector. For example, when the last operation in the charging and levelling steps has been performed, the next step in the program is to command that an internal account of elapsed time be started and kept and continually compared against the time-interval for which the coking-time time-interval selector has been set. When the elapsed time corresponds to the preselected time, only then can a command signal be generated to command that the accessory machines involved in pushing move to the oven in question and perform a pushing operation. Similar remarks apply to the other operations preceding a variable-time-interval operation; e.g., the time interval elapsing between initiation and termination of quenching, the time interval elapsing between discharge of quenched coke onto the coke wharf for drying and the opening of the wharf gates for transfer of the dried coke to the screening station, and so on.

As the sequence of operations in the operation of a coking installation are performed, one by one, a protocol printer 13 prints out, step by step, what is being done and the day and time of day at which the operation is performed, for auxiliary monitoring purposes at the control station and, more importantly, for review and analysis. An indicator panel 14 includes indicators for each travelling accessory machine, and indicates for each machne the oven-number of the oven at which the machine is located at any particular time, and preferably also other locations to which the machine in question will be moved, e.g., the quenching station in the case of the quenching car, and so forth. The indicator-light panel 16 provides an indication, at any given time, of what operation is currently being performed, e.g., charging of an oven, pushing of an oven, etc. The crossbar plug panel 17 is an auxiliary feature for program override. If for example, a particular oven in the battery is out of order, the operating personnel can plug in a plug identifying the out-of-order oven, and all program steps relating to operation of that oven will be automatically skipped. Implementation of this optional feature involves assigning to all program steps associated with the operation of a particular oven a respective code number. When a plug is inserted into the crossbar plug panel 17 to identify an out-of-order oven, all program steps to which the respective program-step code number has been assigned, will be automatically skipped.

It is contemplated according to the present invention to simultaneously coke coal of more than one type. To this end, the overhead coal bin at the loading station 3 is provided with a plurality of bunkers containing coal of different respective types. When a larry car is commanded to move to and be loaded at the loading station, the command information additionally specifies the bunker from which the larry car is to receive coal. The time-interval selectors 15 (e.g., for coking duration, quenching duration, drying duration) are provided in groups, one for each coal-type to be processed, e.g., coal-type #1, #2. The variable time-intervals for which the perforated-tape program commands that the control system keep account of elapsed time will then be compared against the preselected time intervals to which the interval selectors associated with the respective coal-type have been preset.

As already indicated, the most central feature of the inventive method is the use of interlocks dependent upon the arrival of travelling accessory machines at the oven of the commanded oven-number in exact register relative to the middle of the oven in question. These interlocks depend upon the transmission to the control system of feedback information from the travelling accessory machines involved. According to the present invention, the feedback information indicative of the oven-number of the oven at which a particular accessory machine is located at any given time is generated using coded structure, distributed along the travel path of the machine, absolutely indicative of location. I.e., totalization of pulses generated in correspondence to increments of machine travel, or the like, is not relied upon for generating the feedback information indicative of accessory-machine position. Instead, each coke oven is provided with coded structure absolutely indicative of oven-number, i.e., independently of all other coded structure. Code readers on the travelling acessory machines read the coded structure and generate signals indicative of the oven-number, and these signals are then modulated onto a carrier and transmitted back to the control station.

Preferably, the coded structure consists of metallic plates with embedded permanent magnets. The number and/or disposition and/or polarity combinations of the permanent magnets in the coded plate at each oven constitute coded information identifying the respective oven-number. The accessory machines themselves are provided with magnetic-field-responsive code readers which sense the permanent magnets in the coded plate at each oven and generate a corresponding coded signal. The code readers are preferably comprised of Hall generators. The oven-number information is modulated onto a carrier and transmitted to the central control station.

Most preferably, the arrangement of magnets of each coded plate corresponds to a binary-coded number, e.g., the oven-number itself. To this end, it would for example be possible to arrange the magnets of the coded plate in a row extending transverse to the travel direction of the accessory machine and the code reader thereon. The polarity of each magnet (i.e., of the pole thereof facing the code reader) would correspond to a digital zero or one, and in that way establish the binary coding of the oven-number. Preferably, the binary coded numbers of successive code plates along the battery of ovens would progress in simple numerical order, i.e., the polarity combination of the magnets of each coded plate differing from that of its immediate neighbors with respect to the polarity of only one of the magnets thereof.

When, for example, the charging larry is to be moved to a particular oven, it is not sufficient that it be moved into the general vicinity of that oven; it must of course be brought into a position of exact register with the oven, so that the operations involved in loading can be properly performed. The same applies to the other travelling accessory machines. The invention contemplates, in addition to the oven-number identification scheme already described, a fine-positioning technique for bringing the accessory machines into very exact register with the coke ovens with which they are to cooperate. In particular, when an accessory machine has arrived at a particular coke oven, and its code reader has detected that the oven-number of the oven is that of the oven to which it has been commanded to move, a negative-feedback fine-positioning control action should set it. In particular, the transmitter on the accessory machine should transmit back to the control station position information indicative of the sense of the position error, and of the direction in which the accessory machine must be made to travel to reduce the position error. Alternatively, the fine-positioning feedback information can be simple position information directly indicative of position relative to the position of exact register. This position information is compared at the control station with required-position information contained within the program and the control station then transmits to the motive drive for the accessory machine a command signal commanding that the accessory machine move in one direction or the other. Alternatively, the negative-feedback control of the exact position of the accessory machine can be performed at the accessory machine itself, particularly when the accessory machine is itself locomotive. In that event, the accessory machine is provided with a negative-feedback positioning system which controls its drive means, and supplies thereto a position-error signal indicating the direction in which the machine must be moved to bring it into exact register with the required oven. For example, the position-error signal may be positive, negative or zero, depending upon whether the machine must be moved forward, backward, or already is in exactly the position of register. If the negative-feedback positioning system is provided on the accessory machine itself, then this system would not be enabled for operation, until after the accessory machine has transmitted the correct oven-number to the control station, and after the control station has transmitted to the accessory machine a command signal commanding that the negative-feedback fine-positioning system of the accessory machine commence to bring the machine into the position of exact register; this is to prevent the negative-feedback fine-positioning system of the accessory machine from attempting to bring the accessory machine into exact register with every coke oven that the machine passes during its travel.

For generating the fine-positioning information, it is likewise preferred to make use of magnetic structure, preferably on the afore-mentioned code plates themselves. Preferably, each code plate is provided with additional permanent magnets, and the code reader on the accessory machine with an auxiliary code-reader unit, for generating the fine-positioning information. If a position-error signal is to be generated directly, i.e., without subtraction of an actual-position signal from a correct-position signal, use can, for example, be made of two opposite-polarity permanent magnets on the code plate, arranged one next to the other, as considered in the travel direction of the accessory machine. The code reader on the machine would include a further magnetic-field-responsive sensor located to detect the opposite-polarity magnets. When the accessory machine is forward of the position of register, the sensor would detect only the magnet of the first polarity, and generate a positive-polarity position-error signal; when the accessory machine is backward of the position of register, the sensor would detect only the magnet of the second polarity, and generate a negative-polarity position-error signal; when the accessory machine is at exactly the position of register, the auxiliary sensor would detect the opposite-polarity fields emanating from both the magnets, and because the sum of the sensed fields would be zero, would generate a zero-position-error signal. If a fine-positioning actual-position signal is desired, i.e., for subtraction from a fine-positioning required-position signal, different fine-positioning magnet means could be provided on the code plates, for example a sequence of magnets arranged to constitute coded information indicative of a sequence of closely spaced positions centered around the position of exact register.

It will be understood that each of the elements described above, or two or more together, may also find a useful application in other types of combinations of methods steps differing from the types described above.

While the invention has been illustrated and described as embodied in a particular combination of method steps, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a method of controlling the individual operations performed by the travelling accessory machines which travel along the ovens of the coke-oven battery of a coking installation, in combination, the steps of locating coded structures along the length of the travel paths of the travelling accessory machines at the individual ovens of the coke-oven battery, each coded structure at an individual coke oven containing coded information indicative of the oven-number of the respective oven of the battery; providing the travelling accessory machines with code readers operative when the respective accessory machine is moved to an individual coke oven for reading the coded information on the coded structure at the oven and generating and transmitting an oven-number feedback signal indicative of the oven-number of the oven; providing the travelling accessory machines with means operative for generating and transmitting operation-completed feedback signals when individual operations performed by the travelling accessory machines are completed; providing the accessory machines and their motive drive means with receivers for reception of operation-command signals commanding that individual operations performed by the travelling accessory machines be performed and travel-command signals commanding that the travelling accessory machines be moved to individual ovens identified by the travel-command signals; transmitting the operation-command and travel-command signals to the receivers using transmitting means located at a remote control station; utilizing receiving means at the control station for receiving the oven-number and operation-completed feedback signals transmitted from the individual accessory machines; and utilizing a programmable and programmed control system at the control station to cause the travel-command and operation-command signals to be generated and transmitted to the accessory machines in a preprogrammed sequence, the preprogrammed sequence including interlocks which prevent the generation and transmission of at least some of the command signals until after predetermined ones of the feedback signals transmitted from the accessory machines have been received.

2. In a method as defined in claim 1, the preprogrammed sequence of command signals including a travel-command signal commanding that a predetermined accessory machine travel to a predetermined oven followed by a subsequent operation-command signal; and after generation and transmission of the travel-command signal utilizing the programmed control system to compare the oven-number indicated by the travel-command signal against the successive oven-numbers indicated by the oven-number feedback signal received from the respective accessory machine during its travel, and delaying the generation and transmission of the subsequent operation-command signal until after the oven-number indicated by the oven-number feedback signal corresponds to that indicated by the travel-command signal.

3. In a method as defined in claim 1, the preprogrammed sequence of command signals including a plurality of travel-command signals commanding that predetermined ones of the accessory machines all travel to a predetermined oven followed by at least one subsequent operation-command signal; and after generation and transmission of the plurality of travel-command signals utilizing the programmed control system to compare the oven-numbers indicated by the plurality of travel-command signals against the successions of oven-numbers indicated by the respective oven-number feedback signals received from the respective accessory machines during their travel, and delaying the generation and transmission of the subsequent operation-command signal until after the oven-numbers indicated by the oven-number feedback signals correspond to those indicated by the respective travel-command signals.

4. In a method as defined in claim 1, at least a first travelling accessory machine being required at an individual coke oven before that oven can be charged, a plurality of second travelling accessory machines being required at an individual oven before that oven can be pushed, after the generation of a charging-operation travel-command signal utilizing the programmed control system to compare the oven-number indicated by the oven-number feedback signal received from the first machine against that indicated by the charging-operation travel-command signal and delaying the generation and transmission of a charging-operation operation-command signal until after the oven-number indicated by the oven-number feedback signal from the first machine corresponds to that indicated by the charging-operation travel-command signal, after generation of a plurality of pushing-operation travel-command signals commanding that the second machines travel to a specified oven utilizing the programmed control system to compare the oven-numbers indicated by the oven-number feedback signals received from the second machines against those indicated by the respective pushing-operation travel-command signals and delaying the generation and transmission of pushing-operation operation-command signals until after the oven-numbers indicated by the oven-number feedback signals from the second machines correspond to those indicated by their respective pushing-operation travel-command signals.

5. In a method as defined in claim 1, further including the steps of providing at each individual oven along the travel paths of the accessory machines auxiliary coded structure indicative of position relative to a reference location at each individual oven; providing each accessory machine with auxiliary code-reading means operative for sensing the auxiliary coded structure and generating fine-positioning feedback information concerning the position of the respective accessory machine relative to the reference location at the respective oven and utilizing the fine-positioning feedback information to bring the accessory machine into exact register with the oven to which the machine has been commanded to move.

6. In a method as defined in claim 5, transmitting the fine-positioning feedback information to the control station, there comparing it with fine-positioning required-position information and transmitting to the motive drive means of the respective accessory machine a command signal commanding that the accessory machine be moved in the direction required to bring the machine into exact register with the oven to which the machine has been commanded to move.

7. In a method as defined in claim 1, the coking installation including a loading station provided with an overhead coal bin, a quenching station, a coke wharf, a screening station and a conveyor for conveying quenched and dried coke from the coke wharf to the screening station, the accessory machines including a charging larry, a pusher, a guide car and a quenching car, the transmitting of travel-command signals including transmitting travel-command signals commanding that the afore-mentioned accessory machines travel to individual ones of said stations and to individual ovens for performance of oven-charging, ovenpushing, quenching and larry-loading operations, the transmitting of operation-command signals including transmitting operation-command signals commanding the performance of the individual operations involved in charging individual ovens, pushing individual ovens, quenching coke from individual ovens and loading the larry car, the transmitting of operation-command signals also including transmitting signals commanding and controlling the performance of the loading of the larry car, the quenching of coke at the quenching station, and the drying of quenched coke at the coke wharf, and the coking of coal in the individual ovens.

8. In a method as defined in claim 7, furthermore comprising the step of utilizing a protocol printer connected to the programmed control system to automatically print out the sequence and times of performance of the operations performed by the accessory machines and of the travel of the accessory machines to the locations indicated by the travel-command signals.

9. In a method as defined in claim 1, the coking installation being set up for the simultaneous coking of more than one type of coal in different respective ones of the coke ovens, further including the step of utilizing the programmed control system to control the travel of the accessory machines and the individual operations performed by the accessory machines in dependence upon which of the different types of coal is being handled by the machines at any given time.

* * * * *